US011078684B2

(12) United States Patent
Hsu

(10) Patent No.: US 11,078,684 B2
(45) Date of Patent: Aug. 3, 2021

(54) ELECTRIC LATCH CONTROL DEVICE

(71) Applicant: I-TEK METAL MFG. CO., LTD, Tainan (TW)

(72) Inventor: Wei-Chung Hsu, Tainan (TW)

(73) Assignee: I-TEK METAL MFG. CO., LTD., Tainan (TW)

( * ) Notice: Subject to any disclaimer, the term of this patent is extended or adjusted under 35 U.S.C. 154(b) by 615 days.

(21) Appl. No.: 16/024,957

(22) Filed: Jul. 2, 2018

(65) Prior Publication Data

US 2019/0376316 A1 Dec. 12, 2019

(30) Foreign Application Priority Data

Jun. 11, 2018 (TW) ..... 107119962

(51) Int. Cl.
*E05B 47/00* (2006.01)

(52) U.S. Cl.
CPC .. *E05B 47/0047* (2013.01); *E05B 2047/0068* (2013.01)

(58) Field of Classification Search
CPC .. E05B 15/021; E05B 63/244; E05B 47/0046; E05B 47/0047; E05B 2047/0068; E05C 9/004; E05C 9/1808; Y10T 292/68; Y10T 292/696; Y10T 292/699; Y10T 292/702; Y10S 292/65
See application file for complete search history.

(56) References Cited

U.S. PATENT DOCUMENTS

2019/0203503 A1* 7/2019 Chang ..... E05B 47/0603
2019/0376317 A1* 12/2019 Hsu ..... E05B 63/0065

* cited by examiner

*Primary Examiner* — Kristina R Fulton
*Assistant Examiner* — Yahya I Sidky
(74) *Attorney, Agent, or Firm* — Alan D. Kamrath; Karin L. Williams; Mayer & Williams PC

(57) ABSTRACT

An electric latch control device includes a mounting member having an engaging end and a locking member pivotably mounted to the mounting member. A positioning member is pivotably connected to the mounting member and is engageable with the engaging end. A restraining member is engageable with and actuatable by a driving device securely mounted to the mounting member. When the restraining member is in a stopping position preventing pivotal movement of the locking member, the locking member is restrained by the restraining member, and a latch of a door lock is restrained in an opening of the electric latch control device. When the restraining member is in a non-stopping position not preventing pivotal movement of the locking member, the locking member is pivotable from a locking position to an unlocking position to thereby permit disengagement of the latch of the door lock from the opening.

7 Claims, 13 Drawing Sheets

ELECTRIC LATCH CONTROL DEVICE

BACKGROUND OF THE INVENTION

The present invention relates to an electric latch control device and, more particularly, to an electric latch control device that can be directly applied to a current mechanical lock to provide electric control of a latch of the mechanical lock.

A door lock is mounted to a door to jointly pivot together with the door relative to a door frame. The door frame includes a fixed latch hole which receives a latch of the door lock when the door is closed, such that the door cannot be opened before retracting the latch out of the latch hole. Furthermore, when the door lock is in a locking state, a key is required to unlock the door lock for subsequently retracting the latch.

With the progress of technology, more and more electric door locks are applied to doors. An electric door lock can cooperate with a door access card, a mobile phone, or other electronic devices to proceed with locking or unlocking operation. However, replacement of an entire mechanical door lock already mounted to a door is required if it is desired to electrically control opening and closing of the door. As a result, the conventional mechanical door locks cannot be used.

BRIEF SUMMARY OF THE INVENTION

To solve the above disadvantages, the present invention provides an electric latch control device including a mounting member having two pivotal seats spaced from each other. Each of the two pivotal seats includes a first pivotal portion. One of the two pivotal seats includes a second pivotal portion. A casing encloses the mounting member and has an opening. A locking member is pivotably mounted to the mounting member. The locking member includes two pivotal portions and a locking portion between the two pivotal portions. One of the two pivotal portions includes an engaging end. The two pivotal portions of the locking member are pivotably connected to the first pivotal portions of the two pivotal seats, respectively. The one of the two pivotal portions having the engaging end is pivotably connected to the one of the two pivotal seats having the second pivotal portion. The locking member is pivotable between a locking position closing the opening and an unlocking position revealing the opening. A positioning member is pivotably connected to the second pivotal portion. The positioning member includes a first end and a second end. The positioning member is pivotable between an engagement position in which the second end engages with the engaging end and a non-engagement position in which the second end disengages from the engaging end. The positioning member is in the engagement position when the locking member is in the locking position. The positioning member is in the non-engagement position when the locking member is in the unlocking position. A driving device is securely mounted to the mounting member. A restraining member is engageable with and actuatable by the driving device. The restraining member is movable between a stopping position engaged with the first end of the positioning member and a non-stopping position not engaged with the first end of the positioning member.

When the restraining member is in the stopping position, the positioning member is in the engagement position, and the locking member is in the locking position the locking member is prevented from pivoting from the locking position to the unlocking position. When the restraining member is in the non-stopping position, the positioning member is in the engagement position, and the locking member is in the locking position, the locking member is pivotable from the locking position to the unlocking position.

The electric latch control device according to the present invention can proceed with control through an electric measure or technology, such that a conventional mechanical door lock can be used and controlled through the electric measure or technology after cooperating with the electric latch control device according to the present invention.

In an example, a door detecting unit mounted on the mounting member. A driven member is coupled to and jointly pivotable with the locking member. The driven member is configured to actuate the door detecting unit. When the locking member is in the locking position, the driven member proceeds with one of actuating the door detecting unit and not actuating the door detecting unit. When the locking member is in the unlocking position, the driven member proceeds with another of actuating the door detecting unit and not actuating the door detecting unit.

In an example, the mounting member further includes a connecting seat having a movement hole. A push member is movably received in the movement hole. The door detecting unit is mounted on the connecting seat and is aligned with the push member. The driven member includes a surface facing the door detecting unit and a groove defined in the surface. When the locking member is in the locking position, the groove of the driven member is aligned with the push member, and the push member does not actuate the door detecting unit. When the locking member is in the unlocking position, the groove of the driven member is misaligned from the push member, and the push member is moved by the surface of the driven member to actuate the door detecting unit.

In an example, the electric latch control device further includes two first axles. One of the two first axles includes a linking end, wherein the two first axles are coupled to and jointly pivotable with the two pivotal portions of the locking member, respectively. The one of the two first axles having the linking end is coupled to and jointly pivotable with the driven member.

In an example, a bracket is securely mounted on the mounting member, is located between the two pivotal seats, and includes a mounting wall. An actuation member is pivotably mounted to the mounting wall. The actuation member includes an inner end and an outer end. The actuation member is pivotable between a door closing position and a door opening position. A door closure detecting unit is mounted to the mounting wall. The inner end configured to actuate the door closure detecting unit. When the actuation member is in the door closing position, the inner end of the actuation member proceeds with one of actuating the door closure detecting unit and not actuating the door closure detecting unit. When the actuation member is in the door opening position, the inner end of the actuation member proceeds with another of actuating the door closure detecting unit and not actuating the door closure detecting unit.

In an example, the mounting wall further includes an inner surface and an outer surface. The mounting wall further includes a protrusion formed on the inner surface and a pivotal groove extending from the outer surface to an end face of the protrusion. The protrusion includes a movement hole extending from an outer side thereof to the pivotal groove. The actuation member further includes a side and a recess formed on the side and located on the inner end. The actuation member is pivotably received in the pivotal groove. The outer end is located outside of the outer surface. A pressing member is movably received in the movement hole and abuts the side of the actuation member. When the actuation member is in the door closing position, the recess is misaligned from the pressing member, and the pressing member actuates the door closure detecting unit. When the actuation member is in the door opening position, the pressing member moves into the recess, and the door closure detecting unit is not actuated.

In an example, when the locking member is in the locking position, the locking portion of the locking member is substantially perpendicular to the mounting member. On the other hand, when the locking member is in the unlocking position, the locking portion of the locking member is at an angle of 150°-180° to the mounting member.

The present invention will become clearer in light of the following detailed description of illustrative embodiments of this invention described in connection with the drawings.

Figure 1:
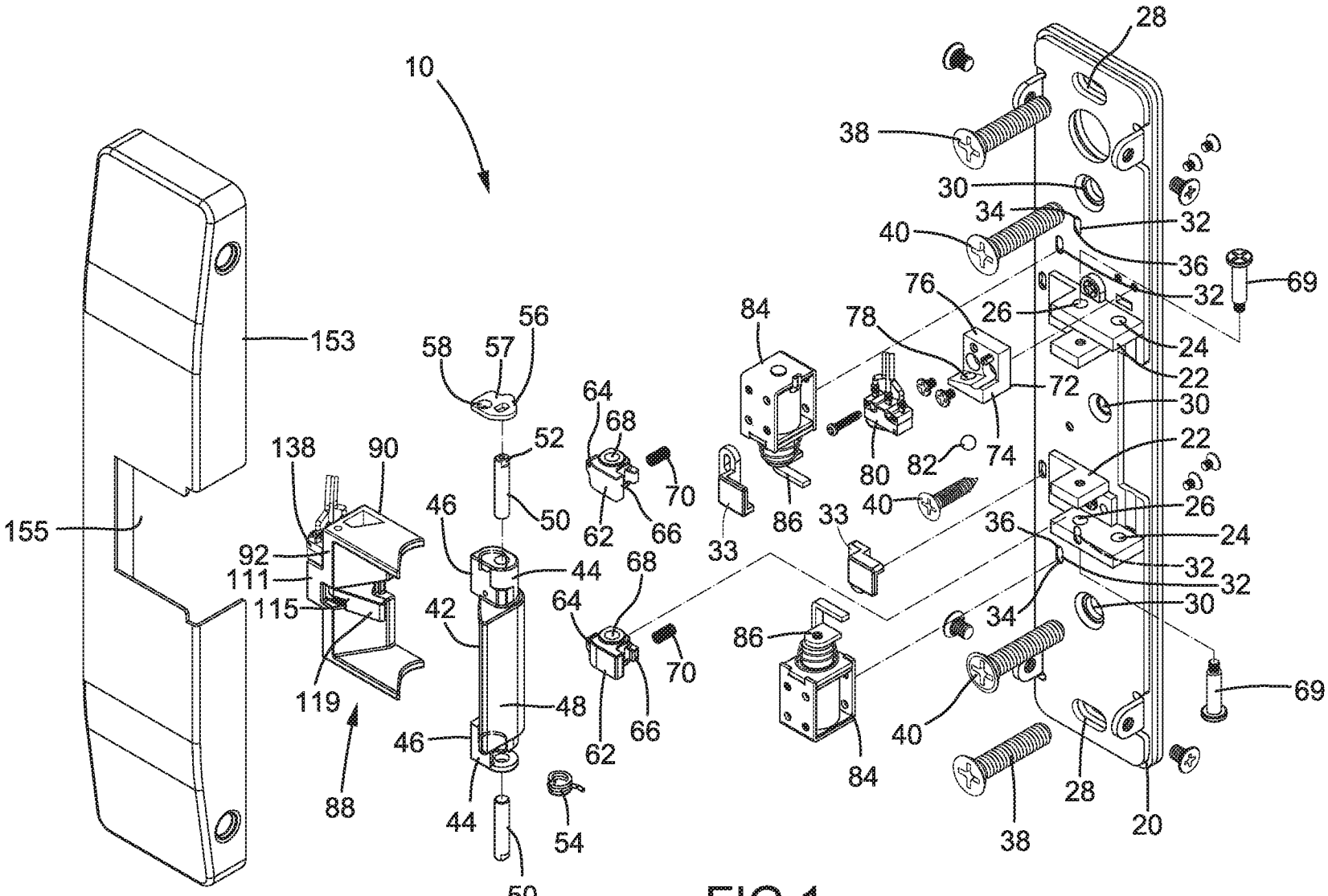
FIG. 1 is an exploded, perspective view of an electric latch control device according to the present invention.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "side", "end". "portion", and similar terms are used herein, it should be understood that these terms have reference only to the structure shown in the drawings as it would appear to a person viewing the drawings and are utilized only to facilitate describing the invention

DETAILED DESCRIPTION OF THE INVENTION

Figure 4:
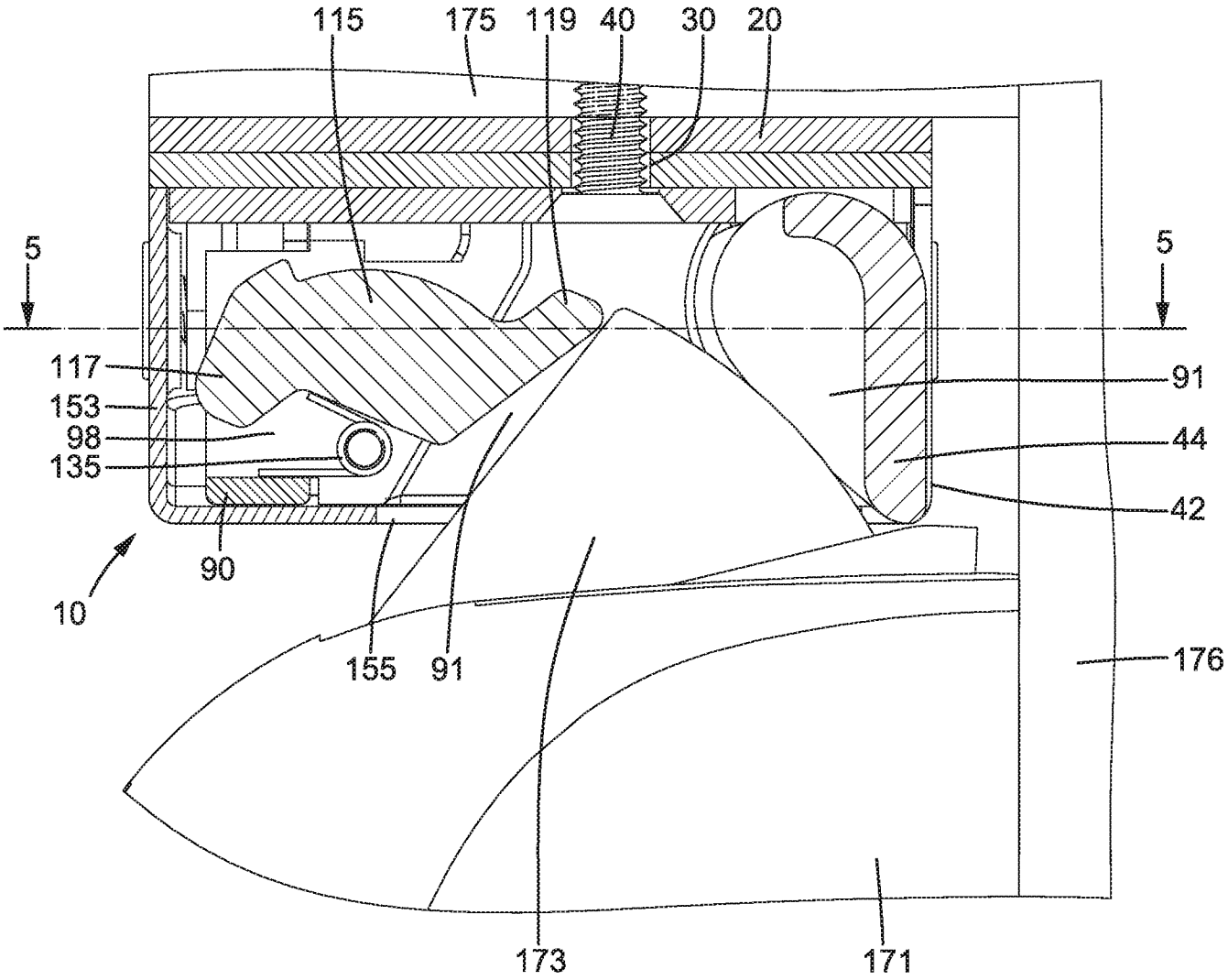
FIG. 4 is a cross sectional view taken along section line 4-4 of FIG. 3, with the electric latch control device fixed to a door frame to which a door with a door lock is mounted.

An electric latch control device 10 according to the present invention is securely mounted to a door frame 175 to restrain or release a latch 173 of a door lock 171 mounted to a door 176 pivotably mounted to the door frame (FIG. 4). With reference to FIG. 1, the electric latch control device 10 includes a mounting member 20 having two pivotal seats 22 spaced from each other. Each of the two pivotal seats 22 includes a first pivotal portion 24 and a second pivotal portion 26 spaced from the first pivotal portion 24. The mounting member 20 further includes a connecting seat 72 fixed at a side of one of the two pivotal seats 22. The connecting seat 72 includes a first portion 74 and a second portion 76, with the first and second portions 74 and 76 arranged in an L-shaped manner. The connecting seat 72 further includes a movement hole 78 in the first portion 74. The mounting member 20 further includes a plurality of mounting holes 32 located outside of the two pivotal seats 22. Each of the plurality of mounting hole 32 has a normally closed end 34 and a normally open end 36. The mounting member 20 further includes two elongated adjusting holes 28 respectively at two ends thereof and a plurality of positioning holes 30 having circular cross sections. The mounting member 20 further includes two limiting members 33 spaced from each other.

The electric latch control device 10 further includes a locking member 42 pivotably mounted to the mounting member 20. The locking member 42 includes two pivotal portions 44 and a locking portion 48 between the two pivotal portions 44. Each of the two pivotal portions 44 includes an engaging end 46 at a side thereof.

The locking member 42 is disposed between the first pivotal portions 24 of the two pivotal seats 22. Two first axles 50 are pivotably coupled with the first pivotal portions 24 of the two pivotal seats 22. Furthermore, the two first axles 50 are coupled to and jointly pivotable with the two pivotal portions 44 of the locking member 42, respectively. Each of the two first axles 50 includes a linking end 52 (located at an outer side of a respective pivotal seat 22, see FIG. 5) that preferably has non-circular cross sections. The two first axles 50 supports the locking member 42 to pivot about the first pivotal portions 24 between a locking position in which the locking portion 48 of the locking member 42 is substantially perpendicular to the mounting member 20 (see FIG. 4) and an unlocking position in which the locking portion 48 of the locking member 42 is at an angle of 150°-180° to the mounting member 20 (see FIG. 9).

Figure 5:
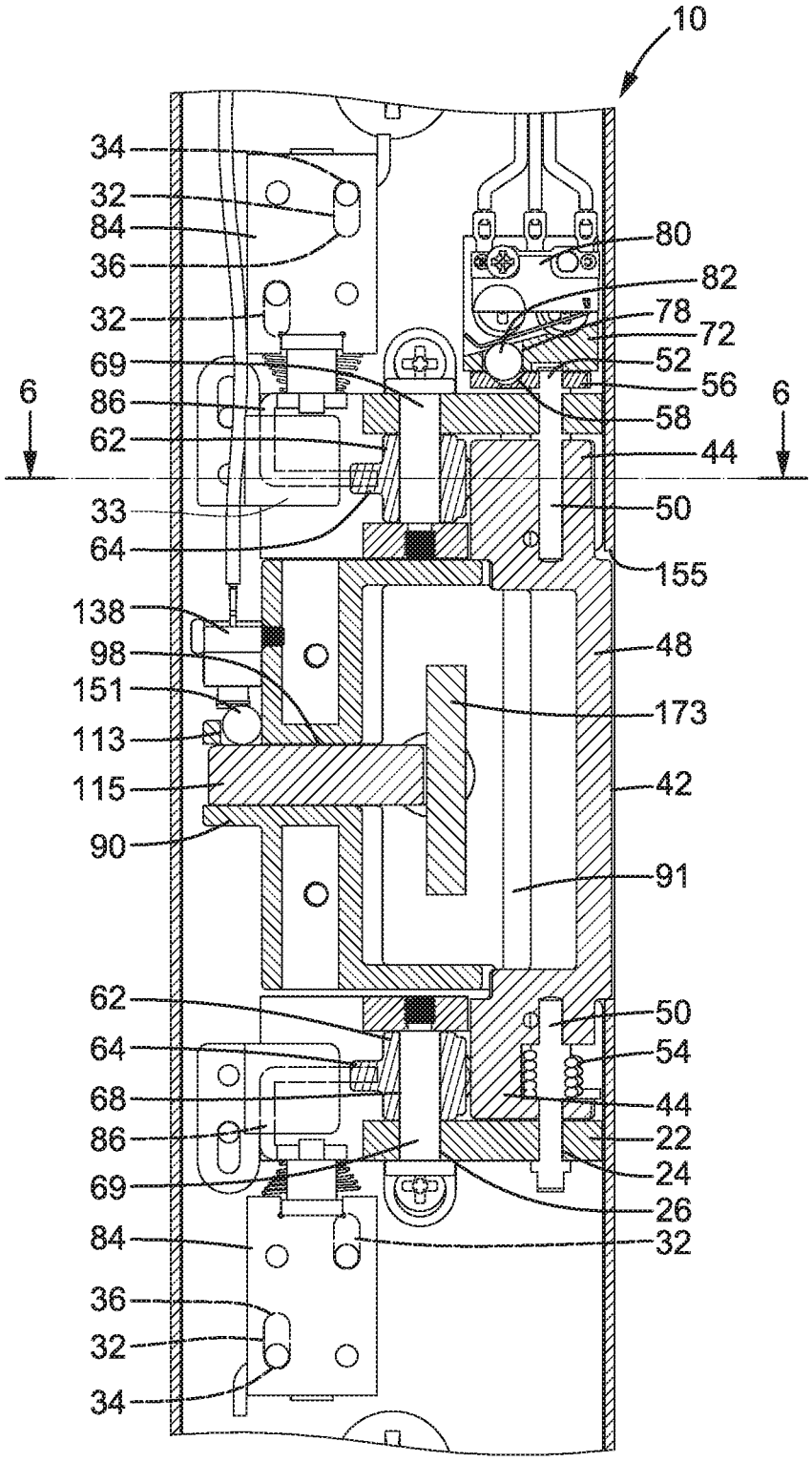
FIG. 5 is a cross sectional view taken along section line 5-5 of FIG. 4.

Furthermore, a return spring 54 is mounted around one of the two first axles 50 and is located between the associated pivotal portion 44 of the locking member 42 and the associated pivotal seat 22 (FIG. 5). The return spring 54 biases the locking member 42 to the locking position.

The electric latch control device 10 further includes two positioning members 62 pivotably connected to the two pivotal seats 22, respectively. Each of the two locking members 62 includes a first end 64, a second end 66, and an axle coupling portion 68 between the first end 64 and the second end 66.

Two second axles 69 are coupled to the second pivotal portions 26 of the two pivotal seats 22, respectively. The axle coupling portion 68 of each of the two positioning members 62 is pivotably coupled to a respective second axle 69. Thus, each of the two positioning members 62 is pivotable about the respective second axle 69 between an engagement position (see FIG. 6) in which the second end 66 engages with the engaging end 46 and a non-engagement position (see FIG. 8) in which the second end 66 disengages from the engaging end 46. Two bias springs 70 are provided, with each of the two bias springs 70 mounted between one of the two positioning members 62 and the respective pivotal seat 22. Each of the two bias springs 70 biases the respective positioning member 62 to the non-engagement position. The positioning member 62 is in the engagement position when the locking member 42 is in the locking position.

The electric latch control device 10 further includes a driven member 56 coupled to and jointly pivotable with one of the two first axles 51. The driven member 56 includes a surface 57 and a groove 58 defined in the surface 57. The driven member 56 is coupled to the linking end 52 of one of the first axles 50 adjacent to the connecting seat 72 (see FIG. 5). Thus, the driven member 56 is actuated to pivot while the locking member 42 is pivoting between the locking position and the unlocking position. In this embodiment, the driven member 56 is disposed between one of the two pivotal seats 22 and the connecting seat 72. A push member 82 is movably received in the movement hole 78 of the connecting member 72. When the locking member 42 is in the locking position, the push member 82 is received in the groove 58 of the driven member 56 (FIG. 5). When the locking member 42 is in the unlocking position, the groove 58 of the driven member 56 disengages from the push member 82. The push member 82 abuts the surface 57 of the driven member 56.

Figure 7:
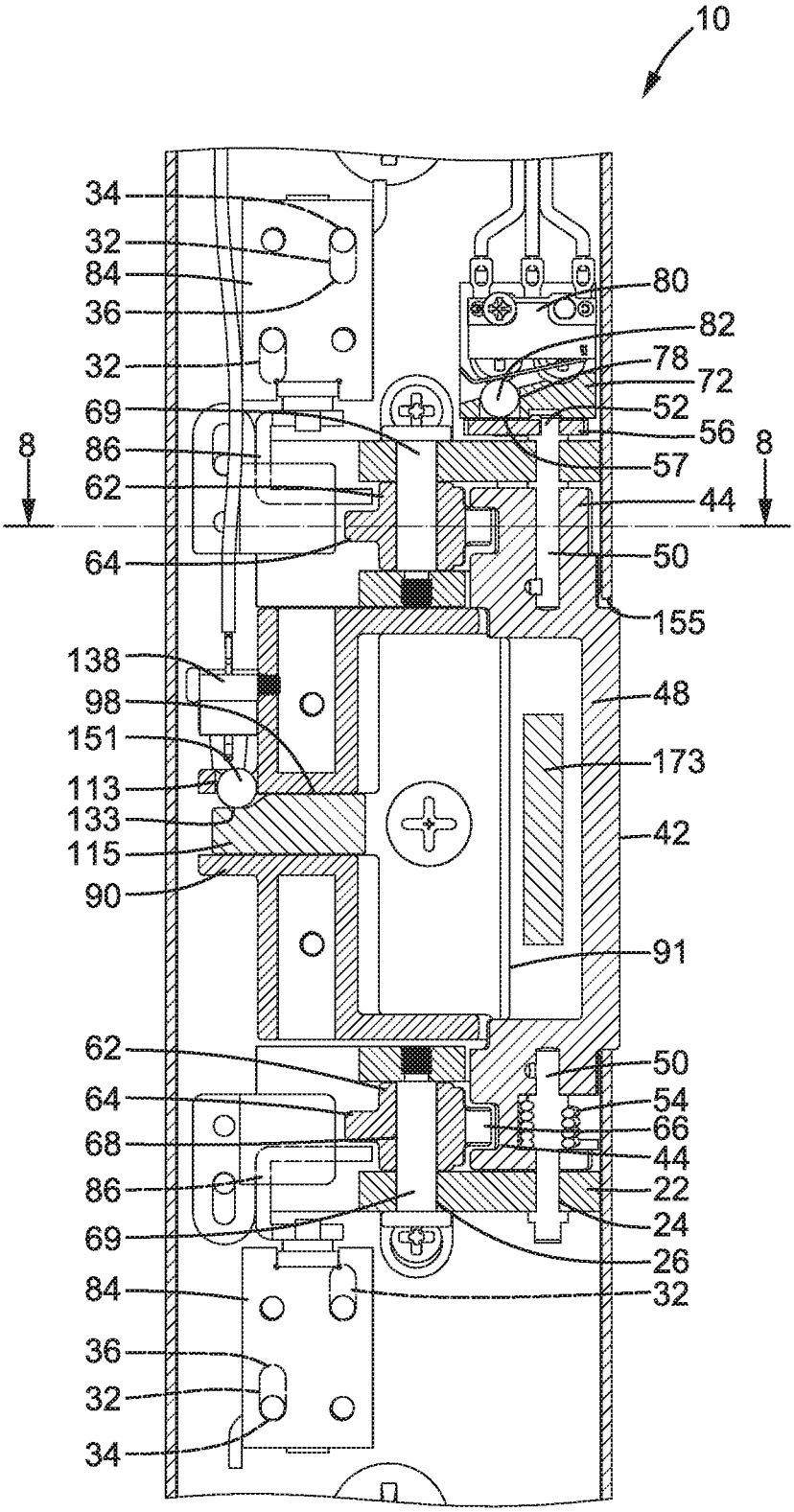
FIG. 7 is a view similar to FIG. 5 with two restraining members of the electric latch control device moved to a non-stopping position.
Figure 10:
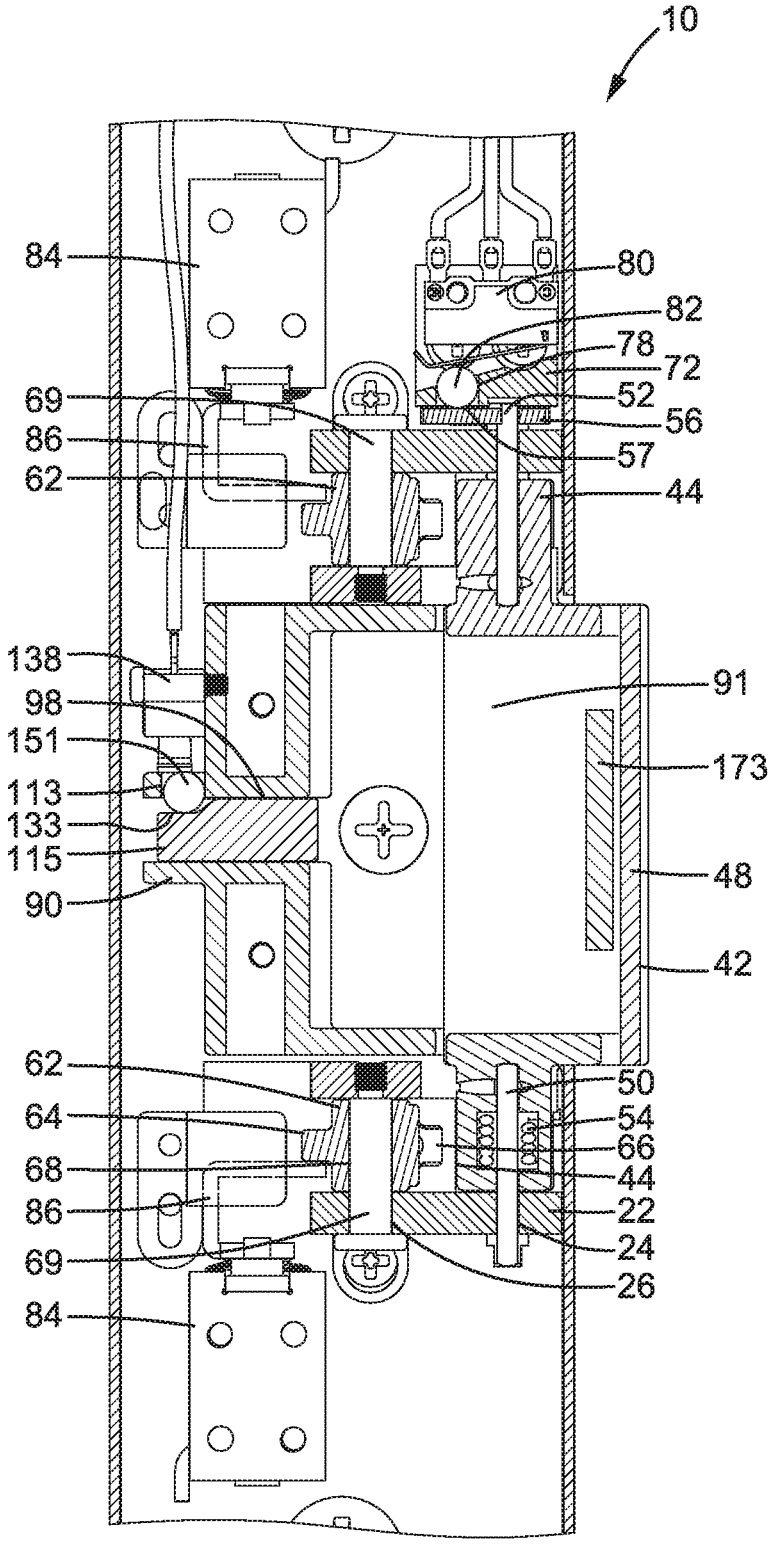
FIG. 10 is a cross sectional view taken along section line 10-10 of FIG. 9.

A door detecting unit 80 is securely mounted to the second portion 76 of the connecting seat 72. Pivotal movement of the driven member 56 selectively actuates or does not actuate the door detecting unit 80. Preferably, the door detecting unit 80 is a microswitch. When the driven member 56 pivots, the door detecting unit 80 is actuated or not actuated through pressing or not pressing from the push member 82. When the locking member 42 is in the locking position, the push member 82 does not press against the door detecting unit 80 (FIG. 5). When the locking member 42 is in the unlocking position, the push member 82 does not press against the door detecting unit 80 (FIGS. 7 and 10). The door detecting unit 80 can be a microswitch of a commercially available type.

The electric latch control device 10 further includes two driving devices 84 securely mounted to the mounting member 20 and two restraining members 86 engageable with and actuatable by the two driving devices 84, respectively. The two driving devices 84 can be electromagnetic valves.

The electric latch control device 10 can be assembled into a normally open state or a normally closed state by installing the two driving devices 84 to a corresponding position on the mounting member 20. With reference to FIG. 5, specifically, when each of the two driving devices 84 is installed to the normally closed end 34 of a respective mounting hole 32, each of the two restraining members 86 is in a stopping position aligned with the first end 64 of a respective positioning member 62 when the respective driving device 84 is not electrified. Each of the two limiting members 33 is installed to a location supporting the respective restraining member 86 in the stopping position. After each of the two driving devices 84 is electrified, the respective restraining member 86 is moved to a non-stopping position (see FIG. 7) misaligned from the first end 64 of the respective positioning member 62.

Figure 12:
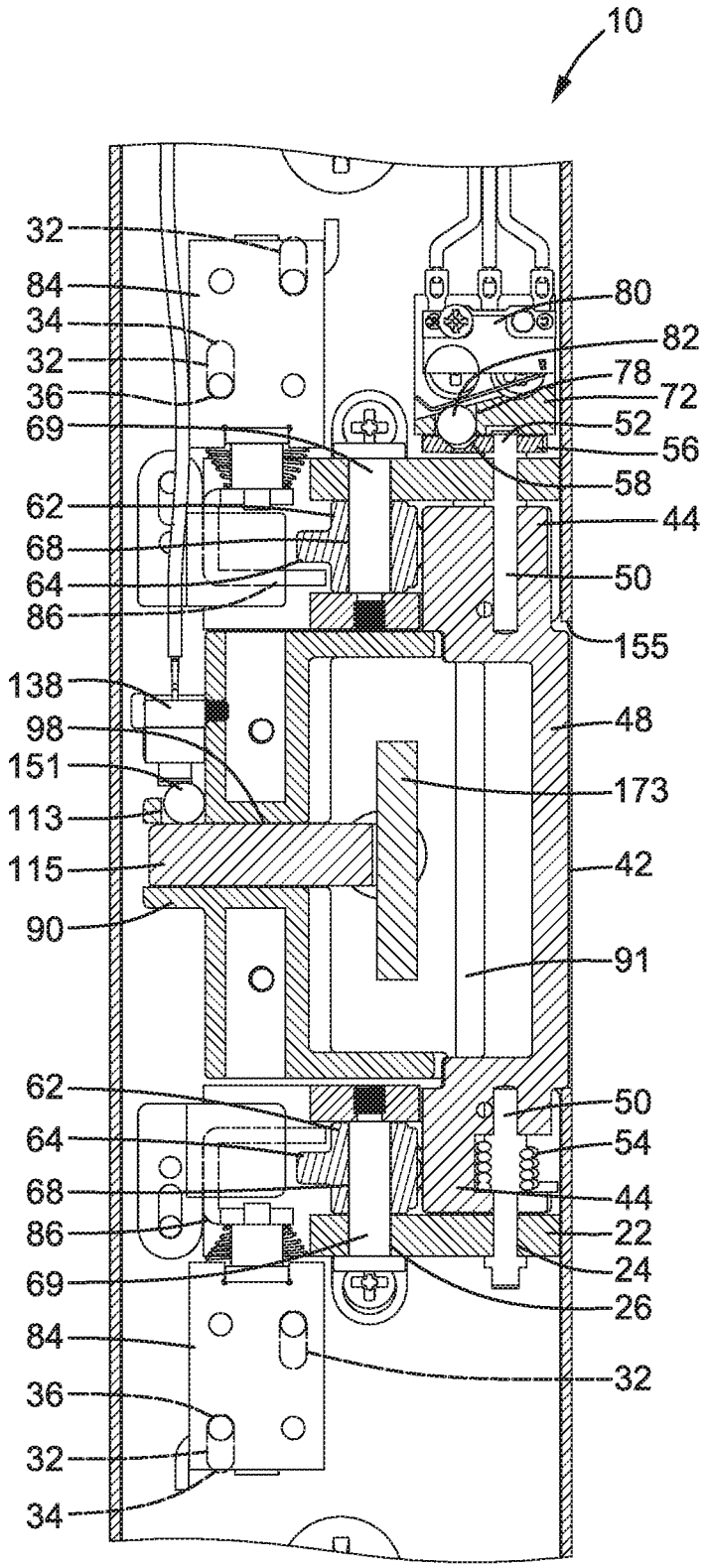
FIG. 12 is a cross sectional view of the electric latch control device with two driving devices mounted in a normally open position.

With reference to FIG. 12, when each of the two driving devices 84 is installed to the normally open end 36 of a respective mounting hole 32, each of the two restraining members 86 is in a non-stopping position misaligned from the first end 64 of the respective positioning member 62 when the respective driving device 84 is not electrified. Each of the two limiting members 33 is installed to a location supporting the respective restraining member 86 in the non-stopping position. After each of the two driving devices 84 is electrified, the respective restraining member 86 is moved to a stopping position (see FIG. 13) aligned with the first end 64 of the respective positioning member 62. Furthermore, the two limiting members 33 are used to position the two restraining members 86 in the stopping position (FIG. 13) or the non-stopping position (FIG. 12) when the two driving devices 84 are not electrified.

Figure 2:
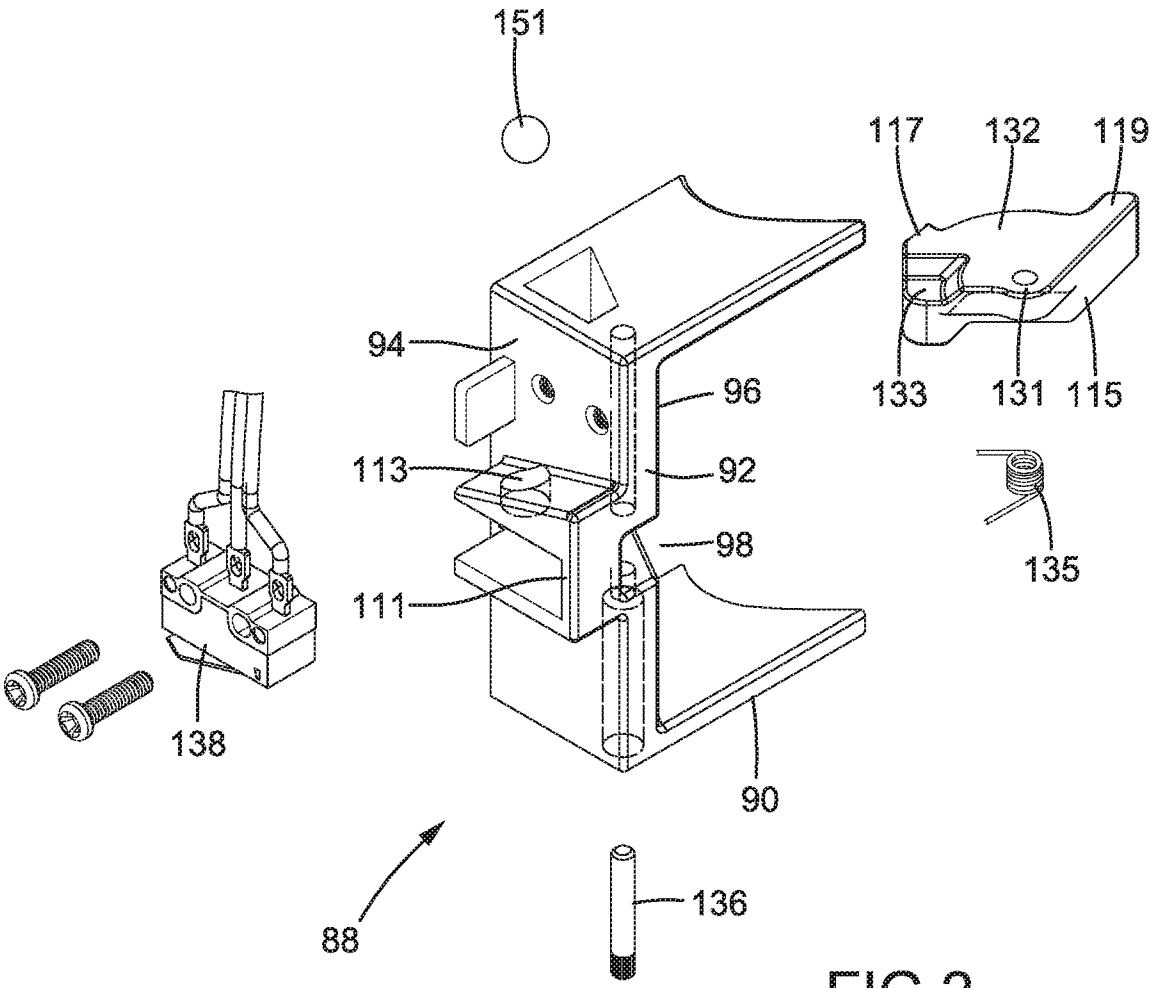
FIG. 2 is an exploded, perspective view of a detecting module of the electric latch control device of FIG. 1.
Figure 3:
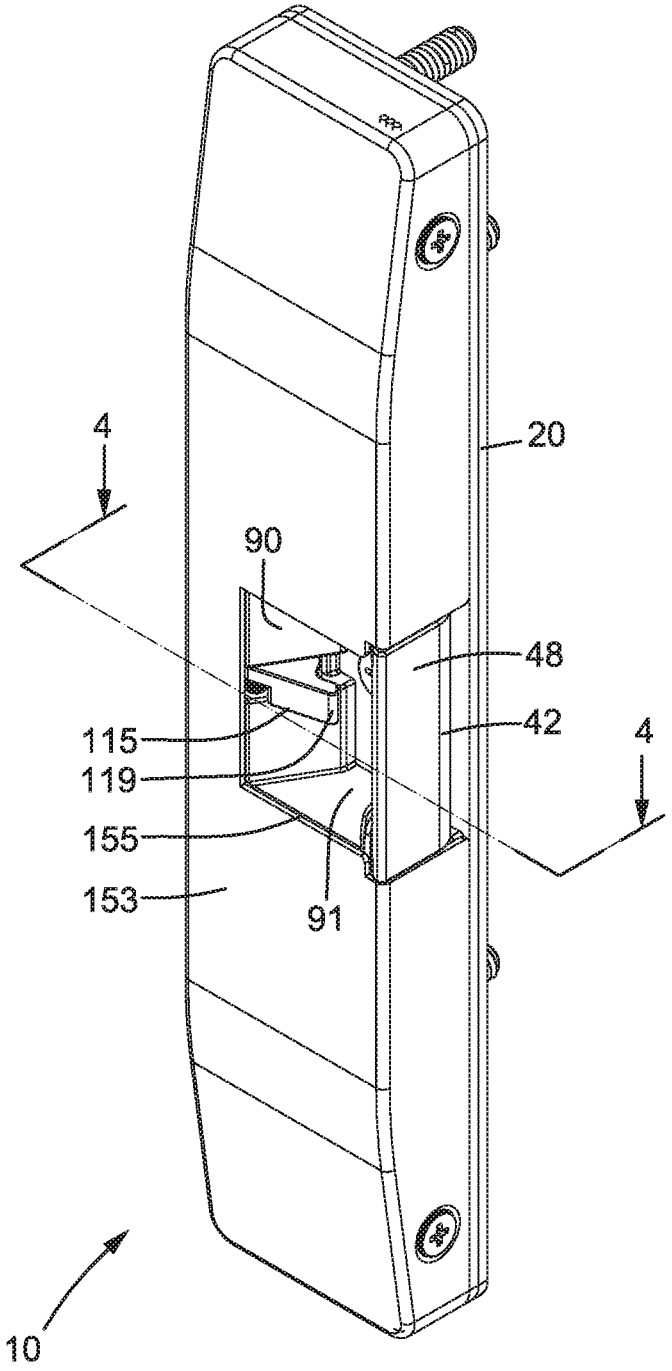
FIG. 3 is a perspective view of the electric latch control device of FIG. 1.

With reference to FIGS. 1 and 2, the electric latch control device 10 further includes a detecting module 88 having a bracket 90 with substantially U-shaped cross sections. The bracket 90 includes a mounting wall 92 having an inner surface 94 and an outer surface 9. The mounting wall 92 further includes a protrusion 111 formed on the inner surface 94 and a pivotal groove 98 extending from the outer surface 96 to an end face of the protrusion 111. The protrusion 111 includes a movement hole 113 extending from an outer side thereof to the pivotal groove 98. The bracket 90 is securely mounted on the mounting member 20 and is located between the two pivotal seats 22. Thus, when the locking member 42 is in the locking position, the locking member 42 and the bracket 90 together define a latch hole 91 (FIGS. 3 and 4).

The detecting module 88 further includes an actuation member 115 pivotably connected to the bracket 90. The actuation member 115 includes an inner end 117 and an outer end 119 spaced from the inner end 117. The actuation member 115 further includes a side 132 extending between the inner end 117 and the outer end 119 and a coupling portion 131 disposed between the inner end 117 and the outer end 119. A recess 133 is formed on the side 132 and is located on the inner end 117.

Figure 9:
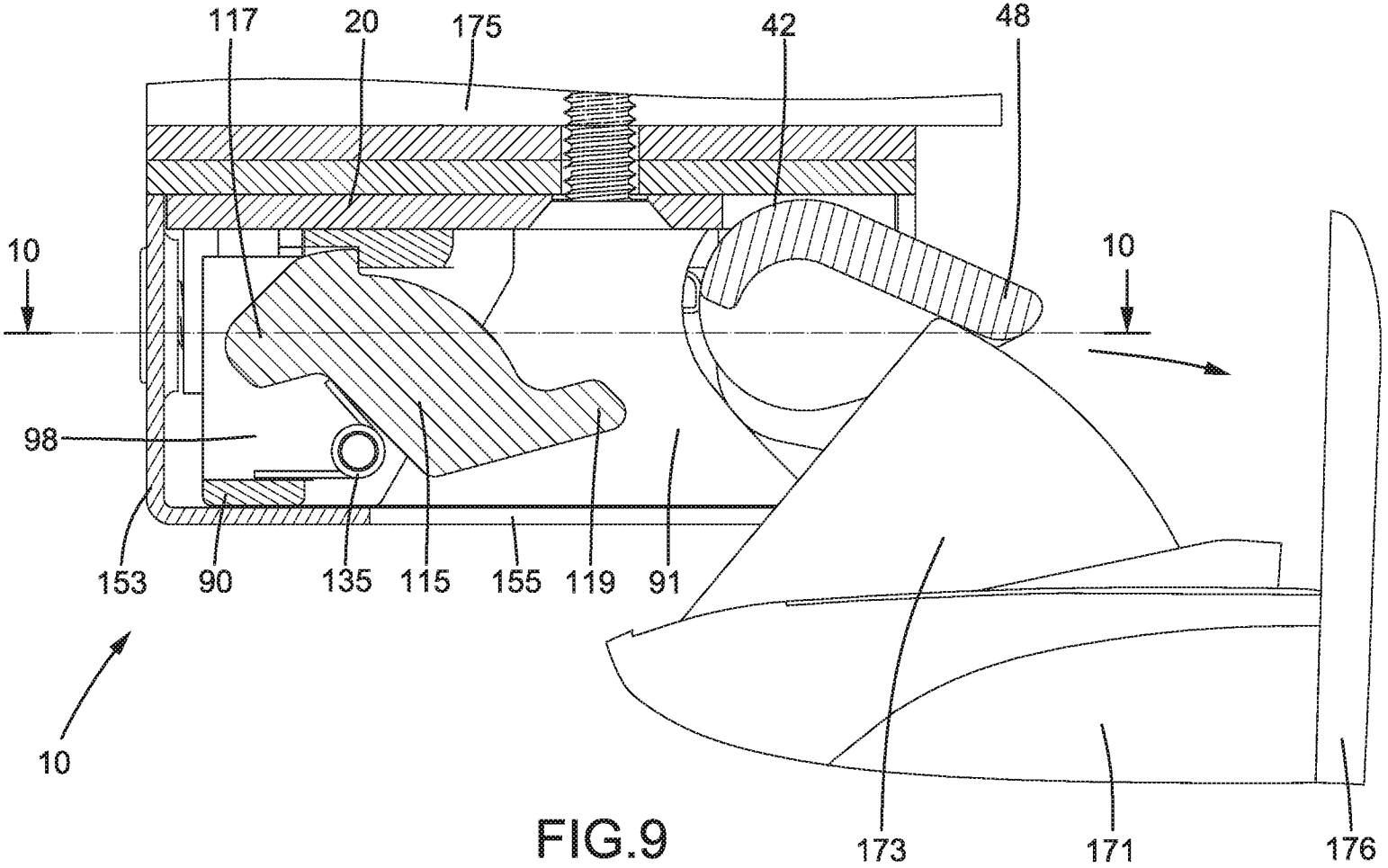
FIG. 9 is a view similar to FIG. 4 with a door opened after the electric latch control device has been unlocked and with a locking member pivoted by a latch of the door lock.
Figure 11:
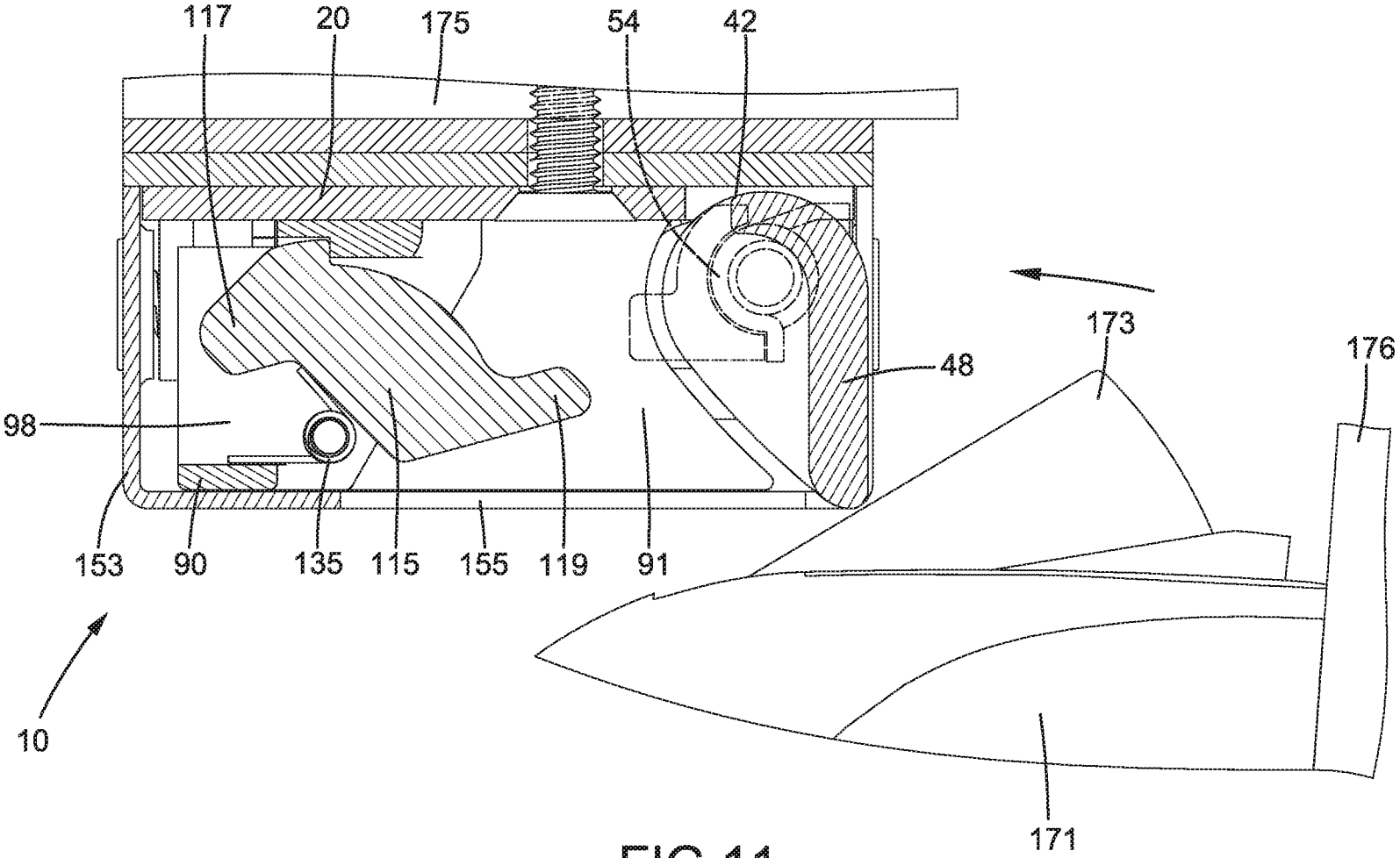
FIG. 11 is a view similar to FIG. 8 with the latch retracted while the door is being closed.

The actuation member 115 is received in the pivotal groove 98. A pin 136 extends through the coupling portion 131 to pivotably connect the mounting wall 92. The outer end 119 of the actuation member 115 is located outside of the outer surface 96. The inner end 117 is located in the protrusion 111. The actuation member 115 is pivotable about the pin 136 between a door closing position (FIG. 4) and a door opening position (FIGS. 9 and 11). A bias spring 135 is mounted around the pin 136, is located between the actuation member 115 and the bracket 90, and biases the actuation member 115 to the door opening position.

The detecting module 88 further includes a door closure detecting unit 138 mounted to the inner surface 94 of the mounting wall 92 and located on a side of the movement hole 113. The detecting module 88 further includes a pressing member 151. The actuation member 115 is selectively disposed to actuate or not to actuate the door closure detecting unit 138. In this embodiment, the pressing member 151 is movably received in the movement hole 113 and abuts the side 132 of the actuation member 115. The pressing member 151 is located between the side 132 of the actuation member 115 and the door closure detecting unit 138. Thus, when the actuation member 115 is in the door opening position (FIGS. 9 and 10), the actuation member 115 is received in the recess 133 of the actuation member 115 and, thus, does not press against the pressing member 151 to actuate the door closure detecting unit 138. On the other hand, when the actuation member 115 is in the door closing position (FIGS. 4 and 5), the pressing member 151 is misaligned from the recess 133 and abuts the side 132. Thus, the actuation member 115 presses against the pressing member 151 to actuate the door closure detecting unit 138.

The electric latch control device 10 is securely mounted to the door frame 175. Particularly, two adjusting screws 38 extend through the two adjusting holes 28 of the mounting member 20 into the door frame 175. Before the two adjusting screws 38 are tightened, the electric latch control device 10 is adjusted relative to the latch 173 of the door lock 171 mounted to the door 176. Then, the two adjusting screws 38 are tightened. Next, three positioning screws 40 extend through the positioning holes 30 into the door frame 175 to prevent the electric latch control device 10 from displacing relative to the door frame 175.

Figure 13:
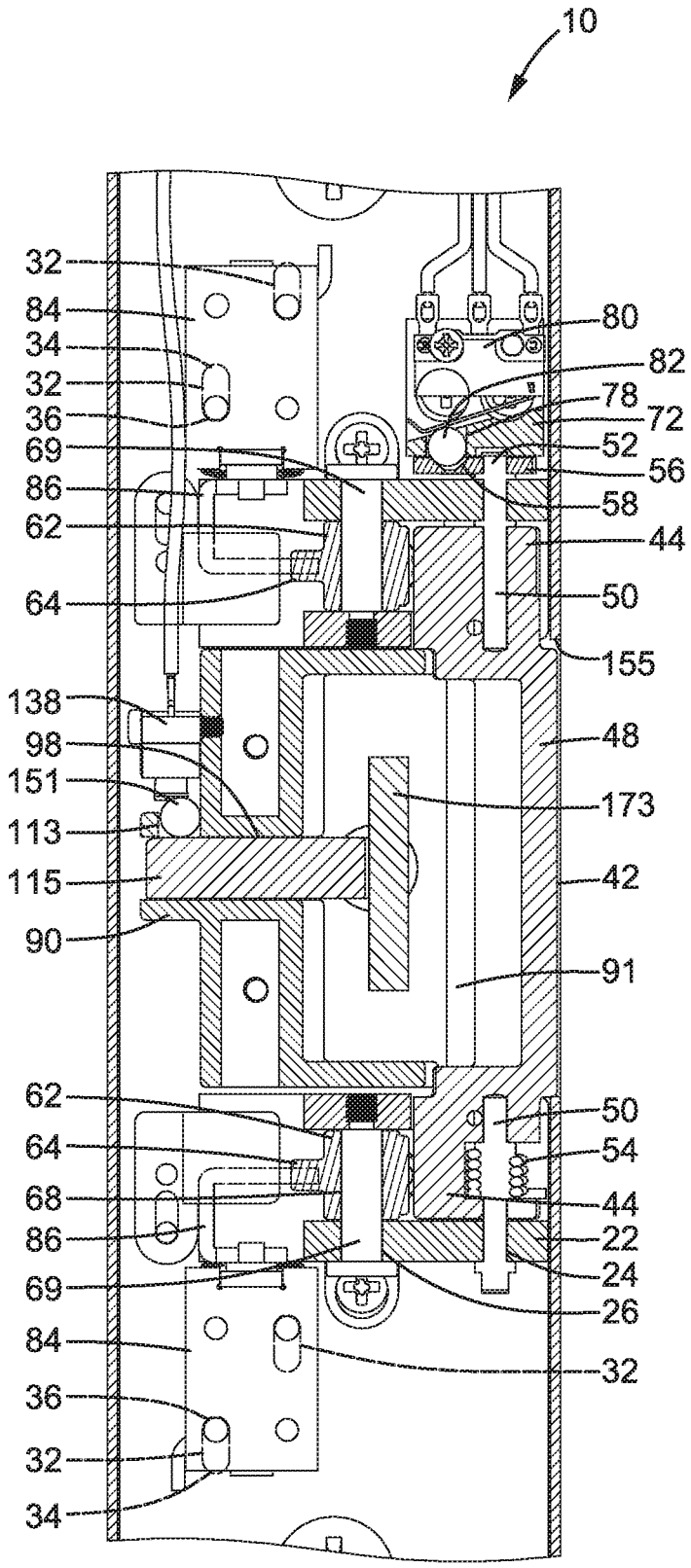
FIG. 13 is a view similar to FIG. 12 with the two driving devices moved to a stopping position.

With reference to FIG. 1, the electric latch control device 10 includes a casing 153 having an opening 155 which is substantially L-shaped and which extends from an outer end face to a side of the casing 153. The casing 153 is securely mounted to the mounting hole 20, and the opening 155 is aligned with the detecting module 88. Only the bracket 90 of the detecting module 88 and the outer end 119 of the actuation member 115 are located in the opening 155 (FIG. 13). When the locking member 42 is in the locking position (FIG. 4), the locking portion 48 covers a side of the opening 155. When the locking member 42 is in the unlocking position (FIG. 9), the locking portion 48 of the locking member 42 does not cover the side of the opening 155.

Figure 6:
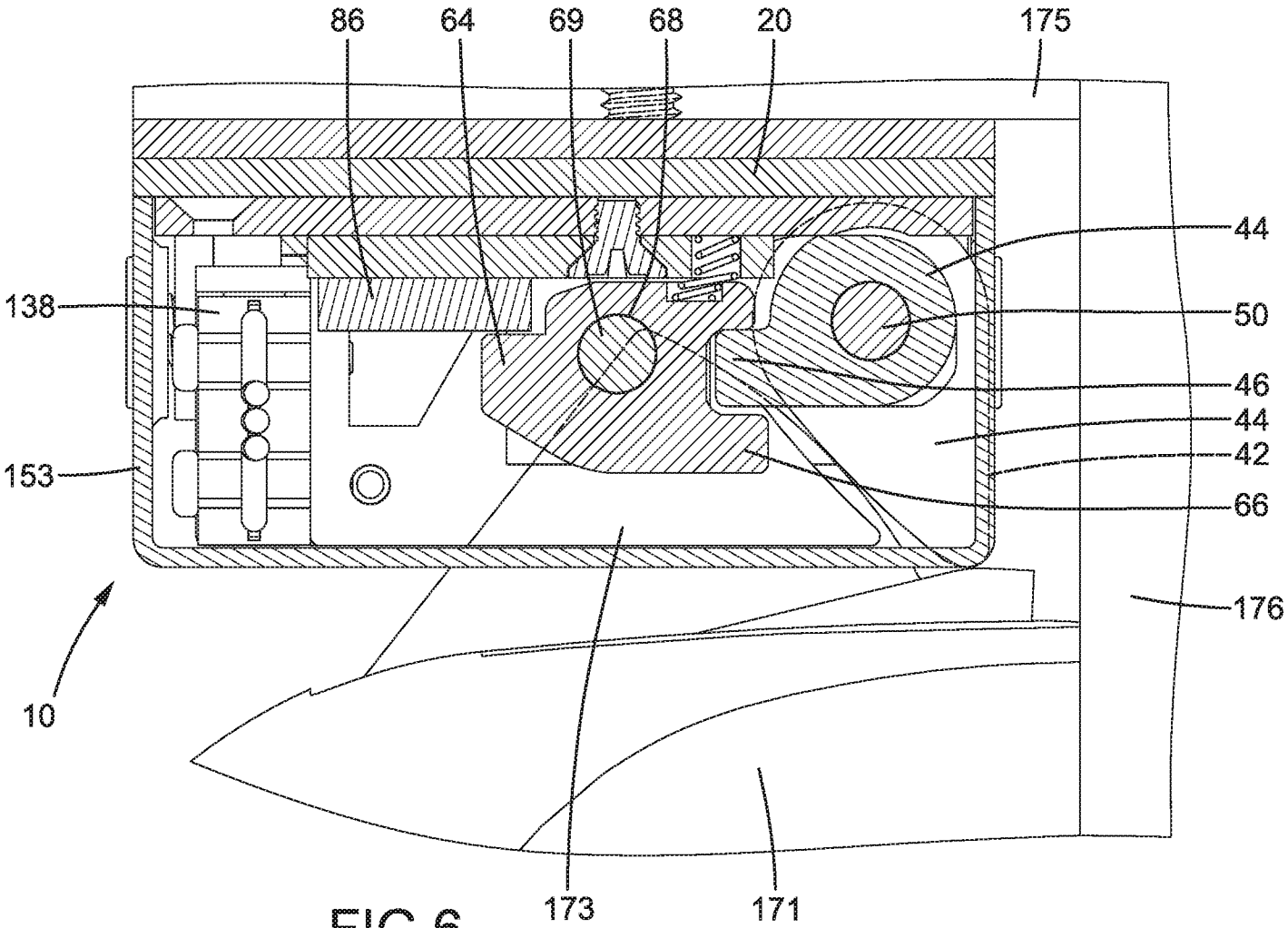
FIG. 6 is a cross sectional view taken along section line 6-6 of FIG. 5.

Now that the basic construction of the electric latch control device 10 of the present invention has been explained, the operation and some of the advantages of the electric latch control device 10 can be set forth and appreciated. In particular, for the sake of explanation, with reference to FIGS. 4-6, it will be assumed that the door 176 is in a closed state, and the two driving devices 84 are installed to the normally closed position. In this case, the latch 173 of the door lock 171 is in the opening 155 and presses the actuation member 115 to the door closing position (FIGS. 4 and 5). Thus, the door closure detecting unit 138 is actuated, and the door is detected to be in the closed state. Furthermore, the locking member 42 is in the locking position, and the two driving devices 84 are not electrified, such that the two restraining member 86 are in the stopping position (FIG. 5). Consequently, the two positioning members 62 are in the engagement position and engage with the engaging ends 46 of the locking member 42 (FIG. 6). Furthermore, the two restraining members 86 are aligned with the first ends 64 of the two positioning member 62 (FIG. 5). Thus, the two positioning members 62 cannot pivot from the engagement position to the non-engagement position to prevent the locking member 42 from pivoting from the locking position to the unlocking position (FIG. 6). Consequently, the electric latch control device 10 is set to a locking state, and the latch 173 of the door lock 171 is restrained in the latch hole 91 to prevent opening of the door 176.

Figure 8:
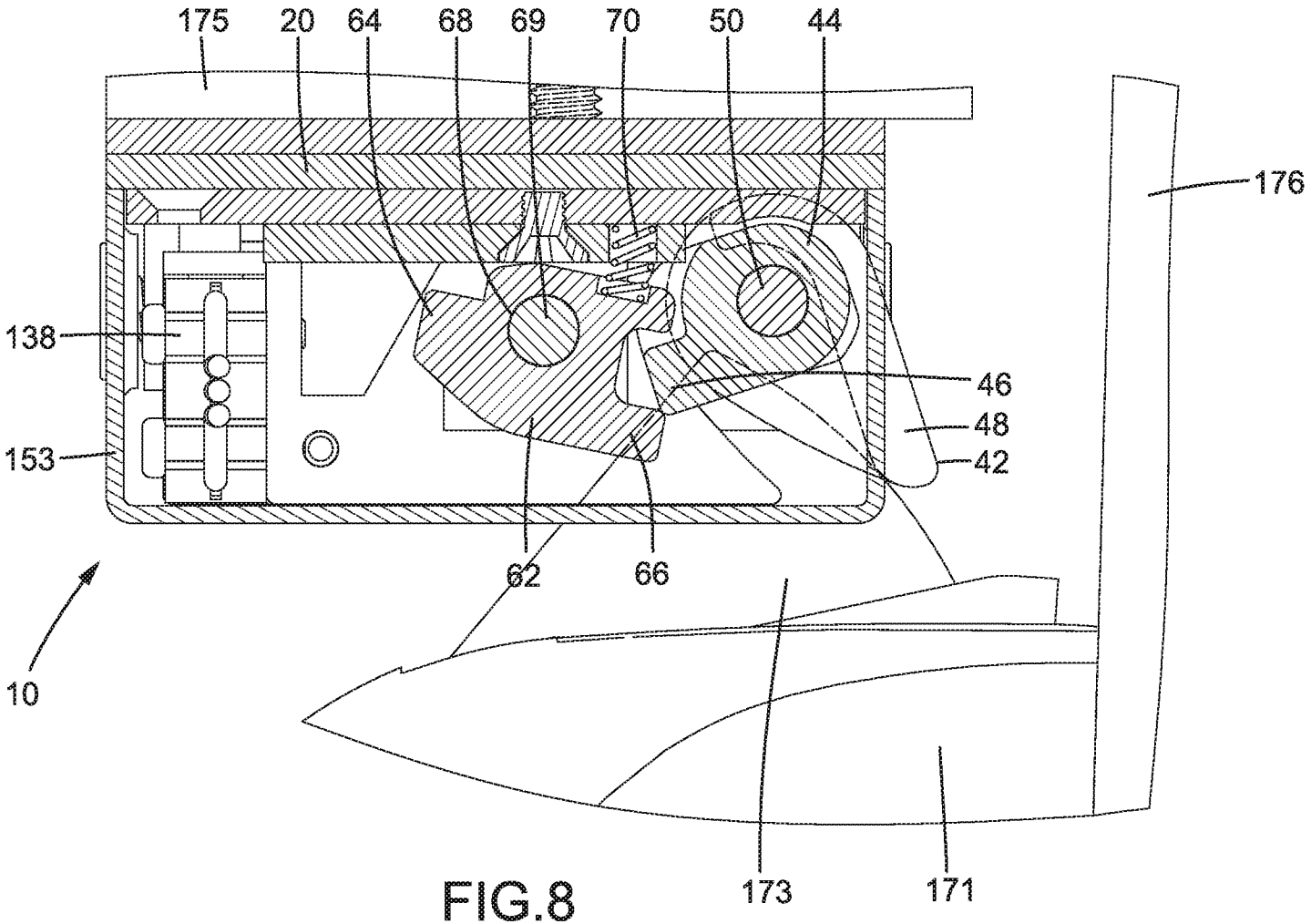
FIG. 8 is a cross sectional view taken along section line 8-8 of FIG. 7.

When it is desired to open the door 176, in an example, a door access card can be used to set the electric latch control device 10 to an unlocking state, such that the two driving devices 84 are electrified to move the two restraining members 86 from the stopping position (FIGS. 5 and 6) to the non-stopping position (FIGS. 7 and 8). After the electric latch control device 10 has been set to an unlocking state, the locking member 42 is permitted to pivot from the locking position to the unlocking position. Thus, without retracting the latch 173 by operating the door lock 171, the door 176 can be directly pushed to press the latch 173 against the locking portion 48 to thereby pivot the locking member 42 (FIG. 8). At the same time, the two positioning members 62 pivot from the engagement position to the non-engagement position, and the engaging ends 46 of the locking member 42 disengage from the second ends 66 of the two positioning members 62 (FIG. 8), such that the locking member 42 pivots from the locking position closing the opening 155 to the unlocking position revealing the opening 155 (FIG. 9) and such that the latch 173 of the door lock 171 disengages from the latch hole 91 of the electric latch control device 10, permitting opening of the door 176.

After the latch 173 of the door lock 171 has completely disengaged from the locking member 42, the return spring 54 returns the locking member 42 to the locking position (FIG. 11). Furthermore, each of the two driving devices 84 is not electrified to return the respective restraining member 86 to the stopping position, and the locking member 42 is restrained in the locking position again and, thus, cannot move to the unlocking position. When the locking member 42 is in the locking position, if it is desired to close the door 176, the latch 173 of the door lock 171 is pressed and retracted by the locking portion 48 of the locking member 42 until the door 176 is completely closed. The latch 173 of the door lock 171 extends into the latch hole 91 again, and the door 176 is locked again.

With reference to FIG. 12, assume the two driving devices 84 are installed at the normally open position, when the two driving devices 84 are not electrified, the two restraining member 86 are in the non-stopping position, permitting the locking member 42 to pivot from the locking position to the unlocking position. With reference to FIG. 13, after the two driving devices 84 have been electrified, the two restraining members 86 move to the stopping position, and the locking members 42 cannot pivot from the locking position to the unlocking position.

The electric latch control device according to the present invention can proceed with control through an electric measure or technology, such that a conventional mechanical door lock can be used and controlled through the electric measure or technology after cooperating with the electric latch control device according to the present invention.

The detecting module 88 can be used to detect whether the latch 173 of the door lock 171 is received in the latch hole 91 to reduce erroneous movement of the electric latch control device 10.

Now that the basic teachings of the present invention have been explained, many extensions and variations will be obvious to one having ordinary skill in the art. For example, only one of the first pivotal seats 22 includes a second pivotal portion 26, only one of the two pivotal portions 44 includes an engaging end 46, and only one of the two first axles 50 includes a linking end 52. Furthermore, the electric latch control device 10 can include only one positioning member 62, only one driving device 84, and only one restraining member 86. The positioning member 62 can still prevent the locking member 42 from pivoting from the locking position to the unlocking position.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An electric latch control device comprising:

a mounting member including two pivotal seats spaced from each other, wherein each of the two pivotal seats includes a first pivotal portion, and wherein one of the two pivotal seats includes a second pivotal portion, a casing enclosing the mounting member and having an opening;

a locking member pivotably mounted to the mounting member, wherein the locking member includes two pivotal portions and a locking portion between the two pivotal portions, wherein one of the two pivotal portions includes an engaging end, wherein the two pivotal portions of the locking member are pivotably connected to the first pivotal portions of the two pivotal seats, respectively, wherein the one of the two pivotal portions having the engaging end is pivotably connected to the one of the two pivotal seats having the second pivotal portion, and wherein the locking member is pivotable between a locking position closing the opening and an unlocking position revealing the opening;

a positioning member pivotably connected to the second pivotal portion, wherein the positioning member includes a first end and a second end, wherein the positioning member is pivotable between an engagement position in which the second end engages with the engaging end and a non-engagement position in which the second end disengages from the engaging end, wherein the positioning member is in the engagement position when the locking member is in the locking position, and wherein the positioning member is in the non-engagement position when the locking member is in the unlocking position;

a driving device securely mounted to the mounting member; and a restraining member engageable with and actuatable by the driving device, wherein the restraining member is movable between a stopping position engaged with the first end of the positioning member and a non-stopping position not engaged with the first end of the positioning member, wherein when the restraining member is in the stopping position, the positioning member is in the engagement position, and the locking member is in the locking position, the locking member is prevented from pivoting from the locking position to the unlocking position, and wherein when the restraining member is in the non-stopping position, the positioning member is in the engagement position, and the locking member is in the locking position, the locking member is pivotable from the locking position to the unlocking position.

2. The electric latch control device as claimed in claim 1, further comprising:

a door detecting unit mounted on the mounting member; and a driven member coupled to and jointly pivotable with the locking member, wherein the driven member is configured to actuate the door detecting unit, wherein when the locking member is in the locking position, the driven member proceeds with one of actuating the door detecting unit and not actuating the door detecting unit, and wherein when the locking member is in the unlocking position, the driven member proceeds with another of actuating the door detecting unit and not actuating the door detecting unit.

3. The electric latch control device as claimed in claim 2, further comprising a push member, wherein the mounting member further includes a connecting seat having a movement hole, wherein the push member is movably received in the movement hole, wherein the door detecting unit is mounted on the connecting seat and is aligned with the push member, wherein the driven member includes a surface facing the door detecting unit and a groove defined in the surface, wherein when the locking member is in the locking position, the groove of the driven member is aligned with the push member, and the push member does not actuate the door detecting unit, and wherein when the locking member is in the unlocking position, the groove of the driven member is misaligned from the push member, and the push member is moved by the surface of the driven member to actuate the door detecting unit.

4. The electric latch control device as claimed in claim 3, further comprising two first axles, wherein one of the two first axles includes a linking end, wherein the two first axles are coupled to and jointly pivotable with the two pivotal portions of the locking member, respectively, and wherein the one of the two first axles having the linking end is coupled to and jointly pivotable with the driven member.

5. The electric latch control device as claimed in claim 1, further comprising a detecting module, wherein the detecting module includes:

a bracket securely mounted on the mounting member and located between the two pivotal seats, wherein the bracket includes a mounting wall;

an actuation member pivotably mounted to the mounting wall, wherein the actuation member includes an inner end and an outer end, and wherein the actuation member is pivotable between a door closing position and a door opening position; and a door closure detecting unit mounted to the mounting wall, wherein the inner end configured to actuate the door closure detecting unit, wherein when the actuation member is in the door closing position, the inner end of the actuation member proceeds with one of actuating the door closure detecting unit and not actuating the door closure detecting unit, and wherein when the actuation member is in the door opening position, the inner end of the actuation member proceeds with another of actuating the door closure detecting unit and not actuating the door closure detecting unit.

6. The electric latch control device as claimed in claim 5, further comprising a pressing member, wherein the mounting wall further includes an inner surface and an outer surface, wherein the mounting wall further includes a protrusion formed on the inner surface and a pivotal groove extending from the outer surface to an end face of the protrusion, wherein the protrusion includes a movement hole extending from an outer side thereof to the pivotal groove, wherein the actuation member further includes a side and a recess formed on the side and located on the inner end, wherein the actuation member is pivotably received in the pivotal groove, wherein the outer end is located outside of the outer surface, wherein the pressing member is movably received in the movement hole and abuts the side of the actuation member, wherein when the actuation member is in the door closing position, the recess is misaligned from the pressing member, and the pressing member actuates the door closure detecting unit, and wherein when the actuation member is in the door opening position, the pressing member moves into the recess, and the door closure detecting unit is not actuated.

7. The electric latch control device as claimed in claim 1, wherein when the locking member is in the locking position, the locking portion of the locking member is substantially perpendicular to the mounting member, and wherein when the locking member is in the unlocking position, the locking portion of the locking member is at an angle of 150°-180° to the mounting member.

* * * * *